US006209265B1

(12) United States Patent
Banicevic et al.

(10) Patent No.: US 6,209,265 B1
(45) Date of Patent: Apr. 3, 2001

(54) REFRIGERATOR DOOR CORNER CONSTRUCTION

(75) Inventors: Nedo Banicevic; Arnold Estravillo, both of Hamilton; Murray Klaas, Burlington, all of (CA)

(73) Assignee: Camco Inc., Mississauga (CA)

( * ) Notice: Subject to any disclaimer, the term of this patent is extended or adjusted under 35 U.S.C. 154(b) by 0 days.

(21) Appl. No.: 09/409,229

(22) Filed: Sep. 30, 1999

(30) Foreign Application Priority Data

May 27, 1999 (CA) ..... 2273476

(51) Int. Cl.[7] ..... E06B 3/00
(52) U.S. Cl. ..... 49/501; 49/382; 49/397
(58) Field of Search ..... 49/382, 385, 386, 49/397, 398, 501, 381; 16/386, 362, 364

(56) References Cited

U.S. PATENT DOCUMENTS

| | | | |
|---|---|---|---|
| 3,042,780 | 7/1962 | Gursahaney | 219/19 |
| 3,089,202 | 5/1963 | Pulaski | 20/16 |
| 3,156,019 | 11/1964 | Dawley | 20/16 |
| 3,290,109 | 12/1966 | Vanegas | 312/326 |
| 3,430,386 | 3/1969 | Sandin et al. | 49/382 |
| 4,084,347 | 4/1978 | Brown | 49/397 |
| 4,151,681 | 5/1979 | Roberts | 49/382 |
| 4,238,908 | 12/1980 | Bunce | 49/501 |
| 4,486,981 | 12/1984 | Billen | 49/501 |
| 5,265,954 | 11/1993 | Keil | 312/405 |
| 5,408,725 | 4/1995 | Wolanin | 16/239 |
| 5,606,773 * | 3/1997 | Shappell | 49/386 X |
| 5,687,509 * | 11/1997 | Barroero et al. | 49/386 |
| 5,787,724 | 8/1998 | Pohl et al. | 62/389 |

* cited by examiner

*Primary Examiner*—Jerry Redman

(57) ABSTRACT

The present invention relates to a door for a refrigerator appliance having reinforcing corner brackets that structurally complete the corners of the door. The corner brackets are located at the door corners of the vertical and horizontal side walls of the outer door skin. The brackets structurally replace and reinforce the horizontal side wall immediately adjacent the vertical side wall with a thicker, stronger material, such as, metal or steel, so that loading normally transferred to the outer door skin through the horizontal side wall at this corner location is instead transferred directly to the brackets mounted in the door. The horizontal side wall at the corner adjacent the vertical side wall has a cut-out or an open section. The brackets each have an opening positioned at the cut-out section. The opening is adapted to receive a hinge pin or closure cap. The door has an elongate supporting strut in the form of a hollow cylindrical tube engaging the brackets to reinforce the corners. The strut extends adjacent the one vertical side wall for supporting the corner brackets within the door to reinforce the door. Reinforcement brackets and tubes are located on each side of the door.

34 Claims, 5 Drawing Sheets

REFRIGERATOR DOOR CORNER CONSTRUCTION

TECHNICAL FIELD OF THE INVENTION

The present invention relates to a door for a refrigerator having load reinforced corners for reducing door loading stresses across the outer door skin.

BACKGROUND OF THE INVENTION

For several years the trend in domestic refrigerator cabinets has been to increase the size and in particular the width of the food compartments and doors in top or bottom mount refrigerators.

Typically, the refrigerator door is constructed from an outer door panel of sheet steel material having rearwardly extending side walls. The door has an inner liner wall of plastic material attached to the door panel. Foam insulation is injected in the space between the outer panel and the inner liner. The foam expands and cures to thermally insulate and rigidize the door.

In order to conserve costs, the amount of steel used in the manufacture of these doors is optimized. The practice is to use a relatively thin sheet of steel for the outer panel. Often this sheet is in the order of 0.017 inches thick. Consequently, in order for the refrigerator door to maintain it's integrity and support articles or items stored on door mounted shelves, one common approach is to reinforce the door with cross braces located within the space of the door between the inner liner and the outer door panel. The metal cross braces extend from the corners of the refrigerator outer panel in an X configuration to reinforce the refrigerator door.

Another known approach to rigidize the door is to use a sheet of paper, aluminum foil or cardboard embedded in the insulation injected into the door cavity. This paper sheet is sufficiently large to cover the inside of the door and is taped to the door to prevent shifting. The sheet improves the rigidity of the door without significantly adding to the weight or cost of the door. More recently, metal sheets have been substituted for paper to improve rigidity. However, the metal sheet adds more weight to the door.

While the above described approaches in refrigerator door construction improve the rigidity of the door, these solutions are more directed to reinforcing the door outer skin and inner liner. To further strengthen the door outer skin, the corners of the door, formed when the skin is rolled back onto itself to provide a supporting peripheral flange for the door liner have been welded to strengthen the corners. However, this results in the distribution of the corner hinge loading forces across the outer door skin which is the very problem for which the above methods of reinforcement are attempting to compensate. Clearly, there is a need for a refrigerator door corner construction that eliminates the problems associated with door corner loading, reinforces the door, and reduces load transfer from the corner through the door onto the relatively thin steel outer skin wall of the refrigerator door.

SUMMARY OF THE INVENTION

It is an object of the present invention to provide a refrigerator door construction having door corner brackets and linking strut supports that improve the rigidity of the door.

It is another object of the present invention to provide a refrigerator door construction having improved corner reinforcement adjacent the side walls of the refrigerator door to reduce the stresses loaded onto the outer skin of the door through the door corners.

The present invention relates to a refrigerator appliance and, in particular, a door for a refrigerator appliance where the door includes reinforcing corner brackets that structurally complete the corners of the door. The corner brackets are located at the door corners adjacent vertical and horizontal side walls of the outer door skin. The brackets structurally replace the horizontal side wall immediately adjacent the vertical side wall with a thicker, stronger material, such as, for example, metal or steel, so that loading normally transferred to the outer door skin through the horizontal side wall at this corner location is instead transferred directly to the brackets mounted in the door. In the preferred embodiment, the horizontal side wall has an open section that is formed as cut-out section located adjacent where the door is normally mounted through hinge pins to the refrigerator appliance. It should be understood that this open section may be formed by rolling the vertical wall around a larger arc to result in an opening.

In accordance with an aspect of the present invention there is provided a door for a refrigerator appliance comprising an outer door panel having an outer skin sheet with rearwardly extending peripheral vertical and horizontal side walls. The door panel has a plurality of corners positioned between adjacent horizontal and vertical side walls. The door has an inner door liner secured to the outer door panel spaced from the sheet to define a cavity between the inner liner and the sheet. The door has reinforcing corner brackets positioned within the cavity adjacent at least two opposed corners located at ends of one of the vertical side walls. The brackets extend along and are secured to at least one of the horizontal and vertical side walls adjacent the vertically opposed corners to reinforce the corners. The door includes an elongate supporting strut having its opposing ends engaging the reinforcing corner brackets. The strut extends adjacent the one vertical side wall to support the corner brackets within the door to reinforce the door.

The corner bracket preferably is a plate that extends across the open or cut-out section of the horizontal wall and adjacent the horizontal wall for securement therewith. The bracket has a depending end peripheral flange that extends towards the cavity and abuts the adjacent vertical side wall. The bracket plate and depending end peripheral flange are crimped to the side walls to secure the bracket at the corner.

Preferably, the brackets include a central opening adjacent the removed horizontal side wall section for receiving a hinge pin and the strut is a hollow metal tube having and end peripheral rim secured to the bracket adjacent the central opening.

BRIEF DESCRIPTION OF THE DRAWINGS

For a better understanding of the nature and objects of the present invention reference may be had to the following detailed description when taken in conjunction with the accompanying diagrammatic drawings wherein.

DETAILED DESCRIPTION OF EMBODIMENTS

Figure 1:
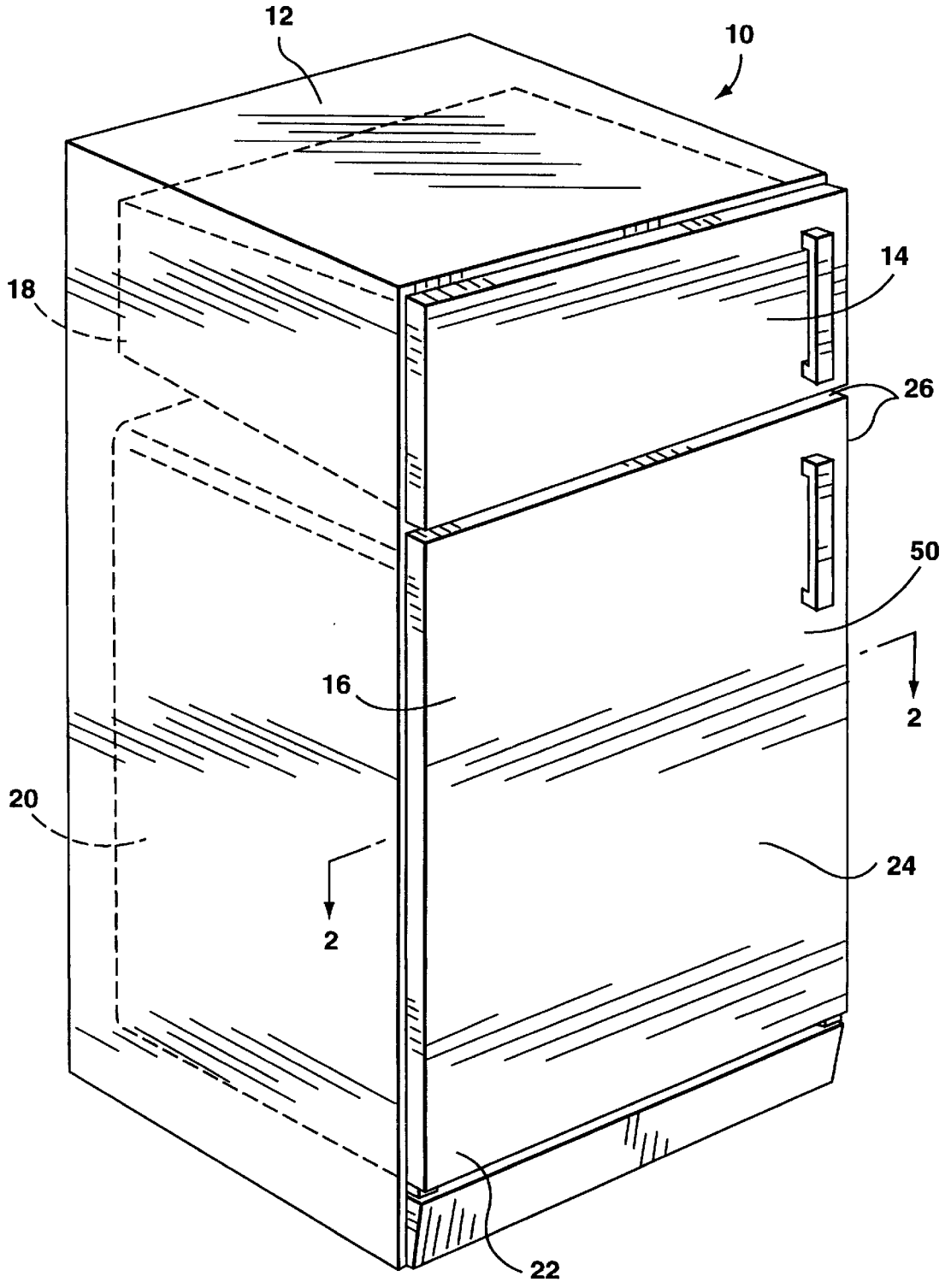
FIG. 1 is a perspective view of a top mount refrigerator appliance having top and bottom doors constructed in accordance with the present invention.

Referring to FIG. 1 there is shown a refrigerator 10 comprising a cabinet 12, a top door 14 and a lower door 16. Each of doors 14 and 16 are shown in a closed position and in the preferred embodiment have a width of 30 inches or larger. The top door 14 is typically adapted to close the freezer food compartment 18 and the lower door 16 typically closes the fresh food compartment 20. Of course it is understood that the position of the freezer compartment 18 relative to the fresh food compartment 20 could be reversed as in a bottom mount refrigerator, or alternatively, the invention has application in side-by-side refrigerator doors. However, in accordance with the present invention, the preferred refrigerator construction is that shown having doors 14 and 16 respectively closing the upper and lower food compartments 18 and 20.

Figure 2:
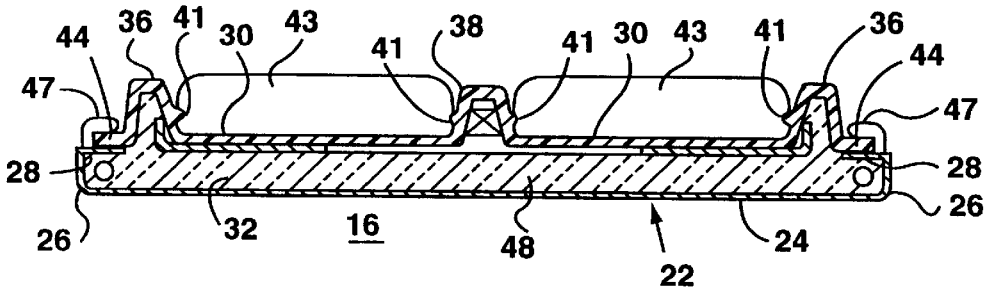
FIG. 2 is a sectional view taken at lines 2—2 of FIG. 1 showing the construction for a refrigerator door.
Figure 3:
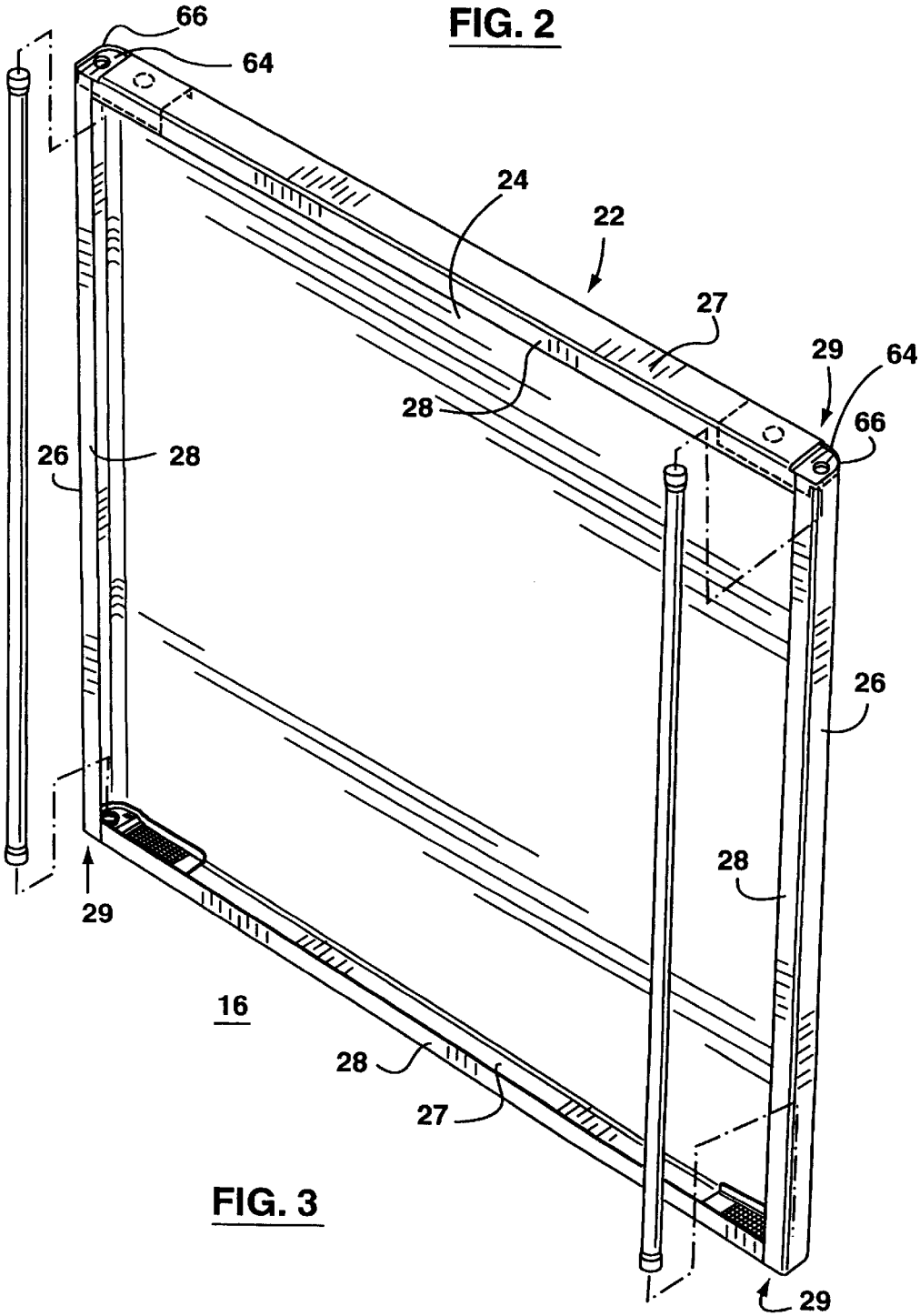
FIG. 3 is a perspective partially exploded view showing the outer door skin from an inside view with the corner reinforcing brackets assembled and the reinforcing tubes about to be assembled.
Figure 4:
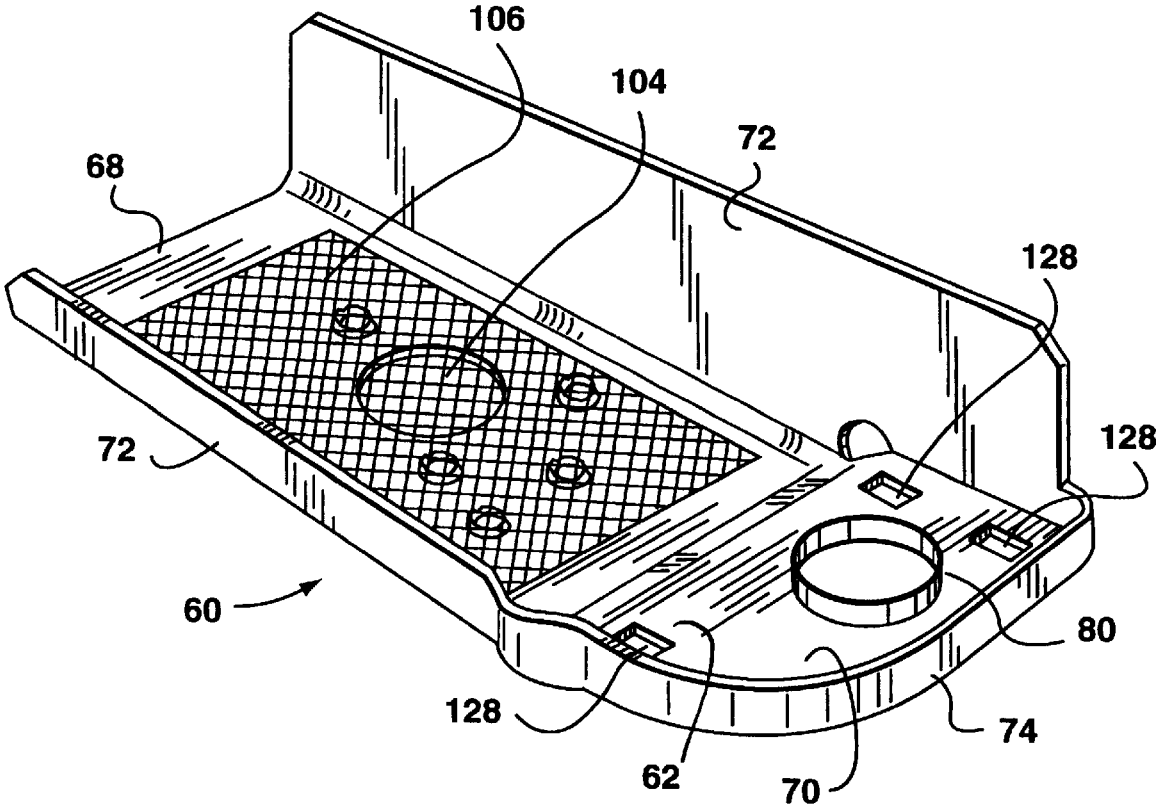
FIG. 4 is a perspective view of the lower left hand bracket shown in FIG. 3 relative to the side wall of the outer door skin.

In FIGS. 1 to 3 the construction of door 16 is shown. Door 16 has an outer metal panel 22. Door panel 22 has a sheet or an outer skin 24 with upstanding or rearwardly extending curved vertical side walls 26 and flat horizontal side walls 27. The vertical side walls 26 and horizontal side walls 27 extend towards each other and would normally meet at corners 29. However, a cut-out or open section 64 is cut out from the horizontal side wall 27 at the corner 29 so that the horizontal side wall does not meet or join the vertical side wall 26. The vertical and horizontal side walls 26, 27 each further include in-turned flanges 28 that preferably extend parallel to the sheet 24 and overlap at the corners 29.

Mounted on top of the in-turned flanges 28 of the door panel 22 is a inner door liner 30 of preferably plastic material. Liner 30 is spaced from the generally flat sheet 24 of the outer door panel 22 to define a cavity 32. The liner 30 has dyke side walls 36 and an interior vertical wall 38. Shelf supports 41 are integrally molded to walls 36 and 38. The shelf supports 41 carry shelves 43 which in turn carry articles (not shown). The liner 30 includes a peripheral edge or flange 44 secured by suitable screw fasteners (not shown) to the in-turned flanges 28 of the outer door panel 22. Mounted over the liner flange 44 and door panel flange 28 is a gasket 47 which seals the door in an airtight fashion with the refrigerator appliance 10. Foamed insulation 48 fills the cavity or space 32 defined between the liner 30 and the outer panel 22.

The refrigerator door 16 as shown in FIGS. 3 through 7 has two unique features. The first unique feature resides in the use of brackets 60, positioned at opposing corners 29, and the reinforcing tube 83 that extends between the brackets 60 supporting the brackets 60 in the door cavity 32. This feature improves the rigidity of the door 16 by providing localized corner reinforcement adjacent the vertical side walls 26 of the refrigerator door 16. By using the bracket 60 and tube 83 in combination with the cut-out section 64 of the horizontal side wall 27, the stresses associated with loading hinge pins 92 of the refrigerator door 16 are distributed through the bracket 60 and are not distributed directly to the outer skin 22. Such direct distribution of force could otherwise cause large heavy doors 16 to warp over extended periods of use. The second unique feature relates to use of an epaulet cover 110 that covers exposed edges of the door corner 29. The epaulet cover 110 covers the exposed edges and effectively joins the side walls of the door corner 29 eliminating the need for welding these side walls to each other at the corner 29. The epaulet cover 110 also compensates for and hides manufacturing imperfections at the door corners 29. The epaulet further improves the visual appearance of the door corners by smoothing the corners and eliminating the visual gap between the epaulet wall and door side walls.

Referring to FIGS. 3 to 5, 7 and 7*a*, the reinforcing corner brackets 60 are shown positioned within the cavity 32 adjacent to the corners 29. Each bracket 60 comprises a plate 62 that extends across a removed or cut-out section 64 from the horizontal wall 27 at the corner 29 adjacent the vertical side wall 26. The width of the bracket 60 is chosen to be substantially the width of the door 16 adjacent the horizontal wall 27 so that the bracket snugly fits into the door corners 29.

The cut-out section 64 of the horizontal side wall 27 leaves exposed peripheral edges 66, 66*a*, 66*b*, 66*c* respectively extending along the outer door skin 24, the curved vertical side wall 26, the in-turned flanges 28, and along the horizontal side wall 27. The exposes edge 66, 66*a*, 66*b*, 66*c* and the removed section 64 can best be seen in FIG. 5.

The bracket plate 62 has a first portion 68 which extends in abutting relation adjacent the horizontal side wall 27. The corner bracket further includes a load bearing surface portion 70 that is recessed in spaced relation from the horizontal wall 27. The load-bearing portion 70 extends across the removed horizontal wall section 64 to engage in abutting relation the inside surface 71 of the vertical side wall 26.

The bracket plate 60 includes opposite side flanges 72 and an end flange 74 which depend from the bracket plate 60 towards the interior cavity 133 of the door. The opposite side flanges 72 respectively abut inside surfaces of the outer door skin 24 and the in-turned flange portions 28 associated with the horizontal side walls 27. These in-turned flange portions 28 are also vertically extending side walls. The opposite side flanges 72 and the first portion 68 are crimped at 77 by a crimping tool to engage the horizontal side wall 27 and the in-turned flange 28 in a tag and lock fastening arrangement.

Figure 7:
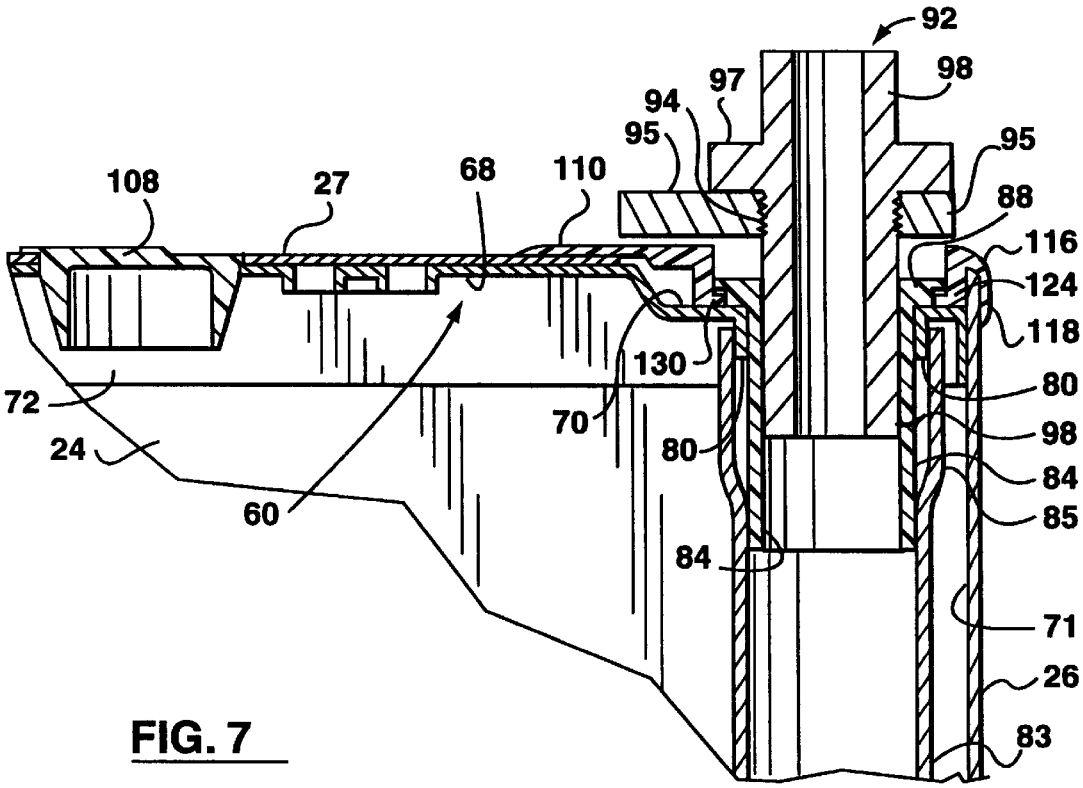
FIGS. 7 and 7*a* are sectional views showing the assembly of the corner reinforcement bracket and the epaulet for the refrigerator respectively at corners having a hinge pin and mounting cap.

The load bearing portion 70 of the bracket member 60 further includes a dependent ring or rim 80. The reinforcing tube 83, preferably metal, has opposed flared ends 85 placed around and engaging rim 80 of the load bearing bracket portion 70 of the bracket member 60. The rim 80 defines a first central opening 87 into which a plastic thimble 84 is inserted in interference fit into the flared ends 85 of the metal tube 83. The thimble 84 has a shaft 86 in interference fit with the metal tube 83. The thimble 84 includes an out-turned head portion 88 which rests on the recessed load bearing surface portion 70 of the bracket member 60. Mounted within the hollow thimble 84 is either an end cap 90 (FIG. 7A) or a hinge pin 92 (FIG. 7). Hinge pin 92 is shown to have a central portion 97 which is of a greater diameter than the diametrically opposed hinge pins 98. The diametrically opposed hinge pins 98 may be hollow to allow for the insertion or passage of conduit or wire along the metal tube between doors. The hinge pin central has threads 94 threadably mounted to a hinge bracket 95 mounted to the refrigerator cabinet. The hinge pin 92 is a central hinge pin for supporting doors 14 and 16. Alternatively, hinge pin 92 could be a lower hinge pin or an upper hinge pin depending on its location.

The door tube 83 is typically foamed in place within the door to rigidly locate the opposing corner brackets 60 between the ends of the rigid tube 83. The door corner reinforcing bracket 60 and metal tube 83 co-operate to reinforce the door corners 29 along the vertical side walls 26 of the refrigerator door 16 and to bear the load associated with the loading of the door 16 onto the hinge pin 92. The bracket reduces the load transferred from the hinge pin 92 directly onto the horizontal side wall 27 and the outer door skin 24. Consequently, the stresses and strains associated with door loading are not directly transferred from the area of the hinge pin 92 onto the outer skin 24 of the door 16. The reduction in the transference of these stresses and the additional reinforcement provided by the metal bracket member 60 and the reinforcing metal tube 83 further rigidizes the door.

In order to assist in venting of gases from the door during the foaming of insulation into the door 16, the horizontal portion 68 of the bracket member 60 extending adjacent the horizontal side wall 27 has a recess or opening 104. Opening 104 is located adjacent a corresponding opening in the horizontal side wall 27. Recess opening 104 is covered with a vent tape 106 which allows gases to escape through the wall 27 and yet prevents the escape of foam. The opening 104 is closed by cap 108 which is shown in FIGS. 7 and 7A secured by interference fit through the horizontal side wall 27 and the horizontal extending bracket portion 68.

Referring to FIGS. 5 through 7A, the epaulet 110 used to cover the cut-out section 64 to complete the door 16 construction is shown. The epaulet 110 has a relatively flat and smooth outer surface 112 having a circular central recess 114 through which the thimble 84 passes. The epaulet 110 has a beveled corner 116 from which depends downwardly or rearwardly a peripheral flange 118.

Figure 5:
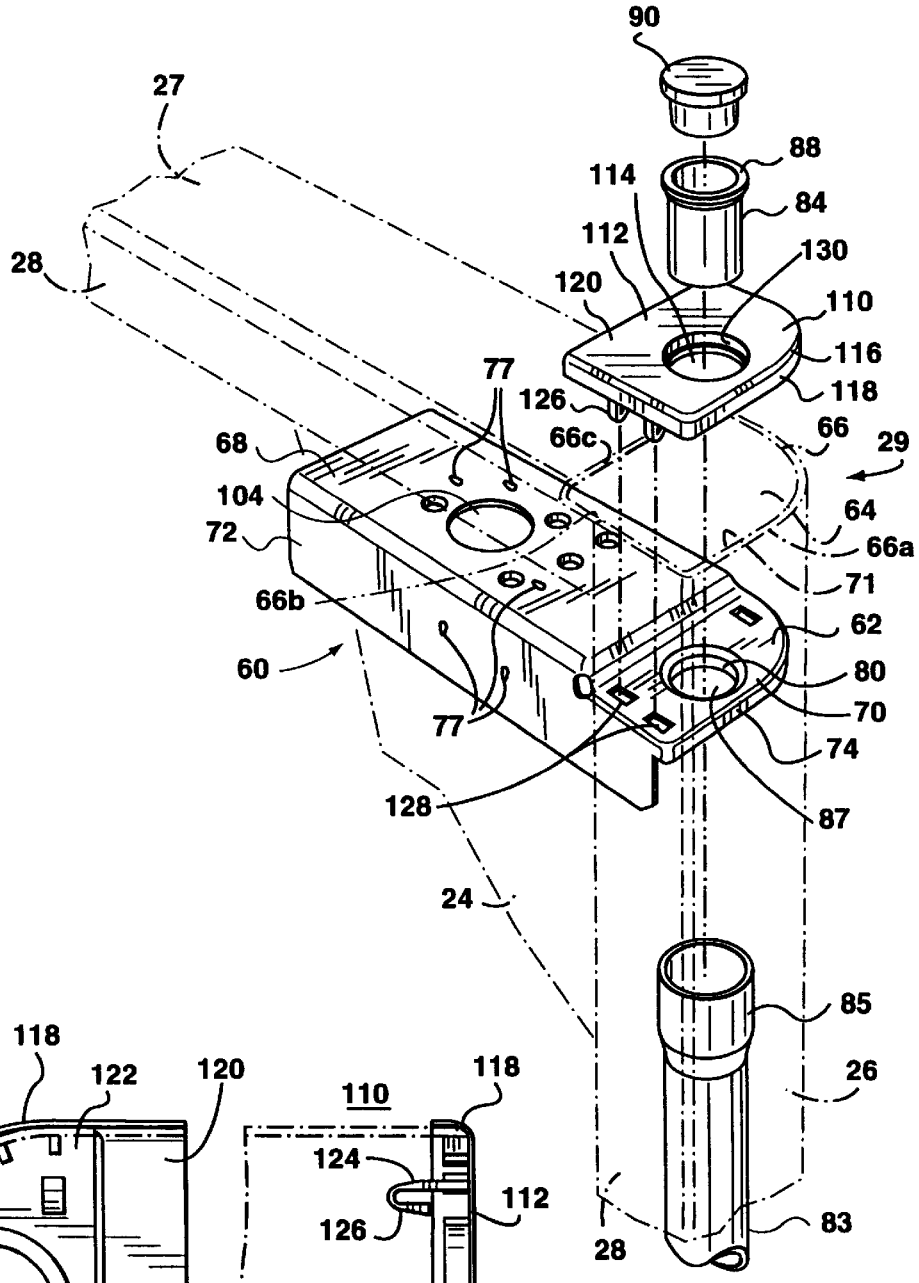
FIG. 5 is an exploded view of the door corner construction and epaulet.

As shown in FIG. 5, the epaulet 110 is positioned over the cut out section 64 such that a flange 118 overlaps outside surface portions of the side wall 26, outer skin 24, and the in-turned flange at 28 of the door. The epaulet cover 110 further has a portion 112 that is adapted to overlay a portion of the horizontal side wall 27.

Figure 6:
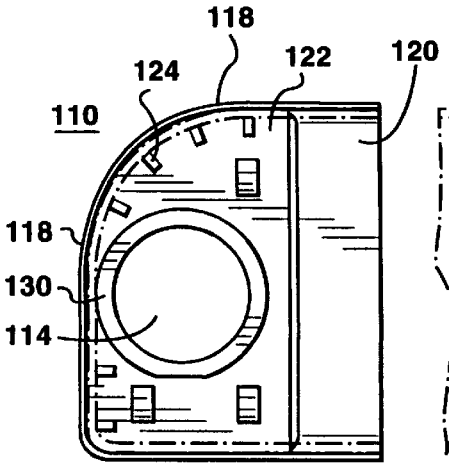
FIG. 6 is a front view looking up at the epaulet shown in FIG. 5.
Figure 6A:
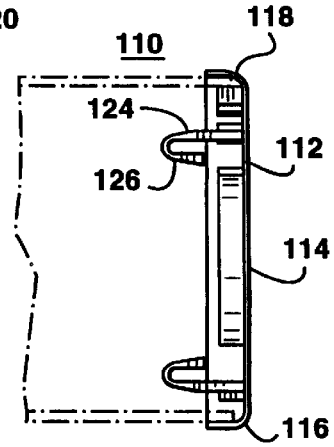
FIG. 6A is a side elevational view of the epaulet of FIG. 6.
Figure 7A:
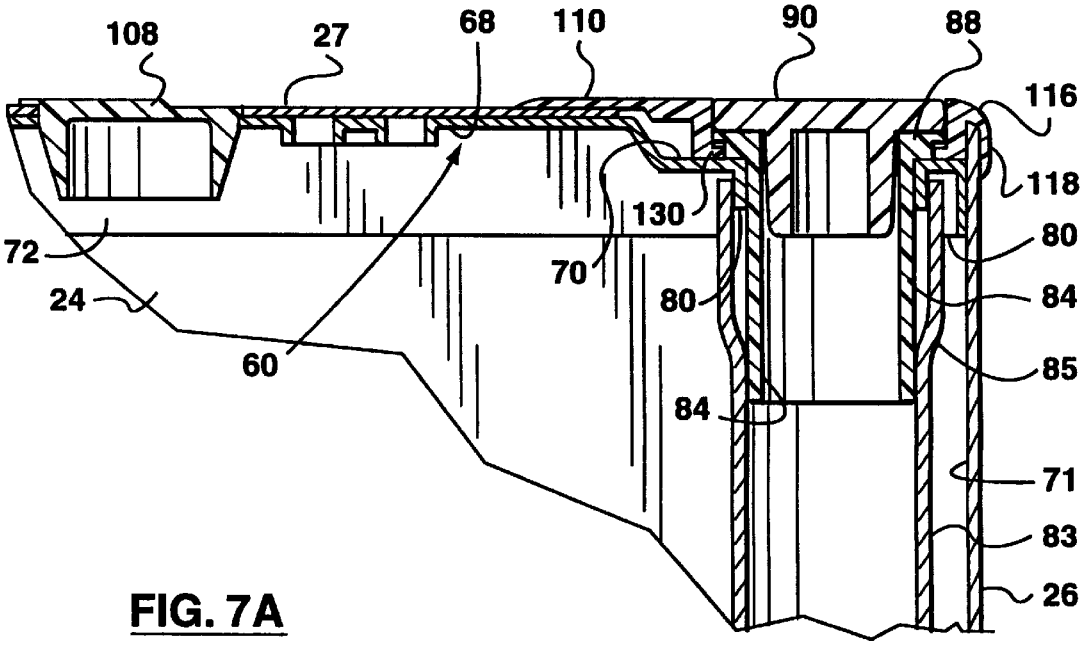

As best seen in FIGS. 6, 7 and 7A, a bottom surface 122 of the epaulet cover 110 has a series of first fasteners or ribs 124. The ribs 124 are spaced a distance from the flange 118 that is equal to or slightly less than the thickness of the metal used in the outer door panel 22. The ribs 124 are adapted to engage inside surface 71 of the vertical sidewall 26 and an inside portion of the other door skin 24.

Thus, as the epaulet cover 110 is inserted onto the horizontal side wall 27 over the cut-out section 64, the ribs 124 co-operate with the depending flange 118 to tightly secure the epaulet cover 110 over the exposed edges 66, 66*a*, and 66*b*. The epaulet cover also overlays a portion of the horizontal side wall 27 covering the exposed edge 66*c*.

As of the epaulet cover 110, is moved into the position covering the cut-out section 66, second fasteners or extensions 124 depending from the underside of the epaulet cover 110 pass through slotted apertures 128 located in the recessed load bearing surface portion 70 of the bracket 60. The extensions 124 of the epaulet cover 110 have hooks 126 that engage the under surface of the bracket 60 preventing of the epaulet cover 110 from being pulled away from the bracket 60. The slotted apertures 128 have a width of that is larger than the width of the extensions 124 so that relative lateral movement of the epaulet cover 110 with respect to the bracket 60 may occur in the longitudinal direction of the horizontal side wall 27.

As best shown in FIGS. 6, 7 and 7A, epaulet cover 110 has a depending circular rim 130 that rests on the recessed load bearing surface 70 of bracket 60. The opening 114 within the rim 130 is aligned with the opening 87 of the bracket 60 and the opening 114 is slightly larger in diameter than the opening 87 of the bracket 60. As a result the rim 130 defines an opening 87 that is adapted to receive hinge pin 92 in a manner that the hinge pin 92 does not translate any loading door forces onto the epaulet cover 110. Hinge pin 92 loads the thimble 84 by resting on the head 88 of the thimble 84 which in turn rests on the recessed load bearing surface 70. The head 88 of thimble 84 is spaced from the rim 130 and does not touch the rim 130. Hence loading of the thimble 84 is not translated onto the epaulet cover 110. The thimble 84 through its interference engagement with a the tube 83 supports the hinge pin 92 relative to the tube 83 with minimal loading of the bracket 60 and with substantially no loading of the epaulet cover 110. This reduces stresses or loads associated with supporting the door 16 to the refrigerator through the hinge pin 90 from being distributed over the other door skin 24 of the door panel 22.

In FIG. 7*a*, a cap 90 replaces pin 92. This permits the opposed vertical sides of the door 16 to be structurally symmetrical with one side of the door pivotally mounted to the cabinet and the other side of the door capped.

As is apparent from the foregoing disclosure, various other embodiments and alterations and modifications which may differ from the embodiments disclosed may be readily apparent to one skilled in the art. It should be understood that the scope of the patent shall be defined by the claims and those embodiments which come within the scope of the claims that follow.

What is claimed is:

1. A door for a refrigerator appliance comprising:

outer door panel having an outer skin sheet with rearwardly extending peripheral vertical and horizontal side walls, a plurality of corners positioned between adjacent horizontal and vertical side walls, and each of the peripheral vertical and horizontal side walls having an inside surface portion adjacent the corners;

an inner door liner secured to the outer door panel spaced from the sheet to define a cavity between the inner liner and the sheet;

reinforcing corner brackets positioned within the cavity adjacent at least two opposed corners located at ends of one of the vertical side walls, the corner brackets each extending within the cavity along the inside surface portions of the horizontal and vertical side walls adjacent the vertically opposed corners to reinforce the corners, and each of reinforcing corner brackets secured to at least one of the horizontal and vertical side walls; and, an elongate supporting strut having opposing ends engaging the reinforcing corner brackets, the supporting strut extending adjacent the one vertical side wall for supporting the corner brackets within the door to reinforce the door.

2. The door for a refrigerator appliance of claim 1 wherein the horizontal side walls have an open section positioned adjacent the vertical side walls.

3. The door for a refrigerator appliance of claim 2 wherein the brackets each include a dependent rim extending into the cavity, and the strut is a hollow tube having opposed ends engaging the dependent rim of the bracket.

4. The door for a refrigerator appliance of claim 3 wherein the tube is cylindrical with its end positioned to surround and engage in interference fit the rim of the bracket.

5. The door for a refrigerator appliance of claim 4 wherein the opposing ends of the tube are flared, and the door further including thimble members each having an elongate shaft inserted though the bracket central opening in interference fit with the flared ends of the tubes, and the thimbles having a flange head spaced overlaying the bracket.

6. The door for a refrigerator appliance of claim 5 wherein the thimble members are plastic.

7. The door for a refrigerator appliance of claim 5 further including a cap adapted to fit into each said thimble member and cover the central opening of the bracket.

8. The door for a refrigerator appliance of claim 5 wherein a hinge pin for supporting the door to the refrigerator appliance is positioned within said thimble member.

9. The door for a refrigerator appliance as claimed in claim 2 wherein the door has a width in excess of 30 inches.

10. The door for a refrigerator appliance of claim 1 wherein the horizontal side walls have an open section adjacent the vertical side walls whereby the horizontal side wall ends at the open section.

11. The door for a refrigerator appliance of claim 10 wherein the brackets each include a central opening, and the strut is a hollow tube having opposed ends that each engage one of the brackets adjacent the central opening for the bracket.

12. The door for a refrigerator appliance of claim 11 wherein the brackets each include a dependent rim extending into the cavity, and the strut is a hollow tube having opposed ends each engaging the dependent rim of the bracket.

13. The door for a refrigerator appliance of claim 12 wherein the tube is cylindrical with its end positioned to surround and engage in interference fit the rim of the bracket.

14. The door for a refrigerator appliance of claim 13 wherein the opposing ends of the tube are flared, and the door further including thimble members each having an elongate shaft inserted though the bracket central opening in interference fit with the flared ends of the tubes, and the thimbles having a flange head spaced overlaying the bracket.

15. The door for a refrigerator appliance of claim 14 wherein the thimble members are plastic.

16. The door for a refrigerator appliance of claim 14 further including a cap adapted to fit into each said thimble member and cover the central opening of the bracket.

17. The door for a refrigerator appliance of claim 14 wherein a hinge pin for supporting the door to the refrigerator appliance is positioned within said thimble member.

18. The door for a refrigerator appliance of claim 10 further including foam insulation in the cavity.

19. The door for a refrigerator appliance of claim 10 wherein the vertical side walls are curved.

20. The door for a refrigerator appliance as claimed in claim 10 wherein the door has a width in excess of 30 inches.

21. A door for a refrigerator appliance comprising:

an outer door panel having an outer skin sheet with rearwardly extending peripheral vertical and horizontal side walls, a plurality of corners positioned between adjacent horizontal and vertical side walls, the horizontal side walls having an open section adjacent the vertical side walls whereby the horizontal side wall ends at the open section, and the outer door panel having in-turned flanges extending from the side walls generally parallel to the sheet;

an inner door liner secured to the outer door panel spaced from the sheet to define a cavity between the inner liner and the sheet;

reinforcing corner brackets positioned within the cavity adjacent at least two opposed corners located at ends of one of the vertical side walls, the corner brackets each extending along and secured to at least one of the horizontal and vertical side walls adjacent the vertically opposed corners to reinforce the corners, and the reinforcing corner brackets each having a plate that extends across the open section of the horizontal wall and adjacent the horizontal wall in abutment therewith, the bracket including opposite side flanges and an end flange that extends towards the cavity, the opposite side flanges respectively abutting inside surfaces of the outer door skin and a corresponding in-turned flange of the horizontal wall, and the end flange abutting the adjacent vertical side wall, and the bracket having a load bearing portion recessed in spaced relation from the horizontal wall and extending across the open section of the horizontal wall to engage the vertical side wall; and, an elongate supporting strut having opposing ends engaging the reinforcing corner brackets, the supporting strut extending adjacent the one vertical side wall for supporting the corner brackets within the door to reinforce the door.

22. The door for a refrigerator of claim 21 wherein at least one of the opposite side flanges and end flange of the bracket and at least one of the in-turned flange and the vertical side wall are crimped together to support the corner.

23. The door for a refrigerator appliance of claim 21 wherein the brackets each include a central opening in the recessed load bearing portion adjacent the open section, and wherein the strut is a hollow tube having opposed ends engaging a corresponding bracket adjacent the central opening.

24. The door for a refrigerator appliance of claim 23 wherein the bracket plate and abutting horizontal wall each including aligned vent openings, and the door further including vent tape overlying the bracket and aligned vent openings to prevent the escape of foam during foaming of the door.

25. The door for a refrigerator appliance of claim 24 further including a vent closure cap snapped into the aligned vent openings in the bracket plate and horizontal side wall.

26. The door for a refrigerator appliance of claim 25 wherein the brackets each include a dependent rim extending into the cavity, and the strut is a hollow tube having opposed ends engaging the dependent rim of the bracket.

27. The door for a refrigerator appliance of claim 26 wherein the tube is cylindrical with its end positioned to surround and engage in interference fit the rim of the bracket.

28. The door for a refrigerator appliance of claim 27 wherein the opposing ends of the tube are flared, the door further including thimble members each having an elongate shaft inserted though the bracket central opening in interference fit with the flared ends of the tubes, and the thimbles having a flange head overlaying the bracket.

29. The door for a refrigerator appliance of claim 28 wherein the thimble members are plastic.

30. The door for a refrigerator appliance of claim 28 further including a cap adapted to fit into the thimble member and cover the central opening of the bracket.

31. The door for a refrigerator appliance of claim 28 wherein a hinge pin for supporting the door to the refrigerator appliance is positioned within said thimble member.

32. The door for a refrigerator appliance of claim 23 further including foam insulation in the cavity.

33. The door for a refrigerator appliance as claimed in claim 23 further including a door sealing gasket extending over the in-turned flange of the side walls of the door.

34. The door for a refrigerator appliance as claimed in claim 23 wherein the door has a width in excess of 30 inches.

* * * * *